US006804908B1

(12) United States Patent
Hanson et al.

(10) Patent No.: US 6,804,908 B1
(45) Date of Patent: Oct. 19, 2004

(54) SHOTGUN SIGHT ATTACHMENT

(76) Inventors: Thomas D. Hanson, 224 Ulster Ave., Saugerties, NY (US) 12477; Paul Alexander, 15 Pennard Court, Toronto, Ontario (CA), M2R 2V8

( * ) Notice: Subject to any disclaimer, the term of this patent is extended or adjusted under 35 U.S.C. 154(b) by 0 days.

(21) Appl. No.: 10/462,048

(22) Filed: Jun. 16, 2003

(51) Int. Cl.[7] ..... F41G 1/52
(52) U.S. Cl. ..... 42/148; 42/111
(58) Field of Search ..... 42/111, 124–128, 42/135–139, 148, 76.01, 141, 146, 71.01, 147, 75.02, 75.03, 85

(56) References Cited

U.S. PATENT DOCUMENTS

| | | | | | |
|---|---|---|---|---|---|
| 1,009,282 | A | * | 11/1911 | Cobb | 42/140 |
| 2,385,649 | A | | 6/1945 | Prideaux | 33/47 |
| 2,795,048 | A | | 6/1957 | Seymour et al. | 33/47 |
| 2,874,504 | A | | 2/1959 | Martinen | 42/76 |
| 3,260,008 | A | * | 7/1966 | Hunt | 42/111 |
| 3,292,264 | A | * | 12/1966 | Kincannon | 42/127 |
| 3,974,586 | A | | 8/1976 | Kappner | 42/1 |
| 3,975,851 | A | | 8/1976 | Bedford | 42/1 |
| 4,697,226 | A | * | 9/1987 | Verdin | 362/110 |
| 4,745,686 | A | | 5/1988 | Willis | 33/254 |
| 4,941,277 | A | | 7/1990 | Lawlor | 42/100 |
| 5,092,071 | A | * | 3/1992 | Moore | 42/85 |
| 5,471,777 | A | * | 12/1995 | McDonald | 42/132 |
| 5,878,503 | A | | 3/1999 | Howe et al. | 33/241 |
| 5,913,669 | A | * | 6/1999 | Hansen et al. | 42/146 |
| D433,478 | S | | 11/2000 | Edgar | D22/110 |
| D447,206 | S | | 8/2001 | Ling, Jr. | D22/109 |
| 6,336,285 | B1 | * | 1/2002 | Baumer | 42/124 |
| 6,421,946 | B1 | | 7/2002 | LaRocco | 42/111 |
| 6,490,822 | B1 | | 12/2002 | Swan | 42/71.01 |
| 6,598,331 | B1 | * | 7/2003 | Thibodeaux | 42/111 |

FOREIGN PATENT DOCUMENTS

| | | |
|---|---|---|
| DK | 92245 | * 11/1961 |

* cited by examiner

*Primary Examiner*—Jack Keith
*Assistant Examiner*—Troy Chambers

(57) ABSTRACT

A shotgun sight attachment is provided for use with a shotgun for mounting sights. An elongated member is included which has a front end and a rear end as well as a lower surface and an upper surface. A front plate is mounted at the front end of an elongated member which extends from the lower surface away from the upper surface. A pair of openings are located in the front plate. A saddle is located on the lower surface at the rear end of the elongated member. The saddle rests on the barrel of a shotgun and one opening in the front plate is slid over the barrel of the shotgun and the other is secures the front plate to the shotgun by use of a magazine cap or a cover which is secured by a bolt to the shotgun.

3 Claims, 4 Drawing Sheets

SHOTGUN SIGHT ATTACHMENT

BACKGROUND OF THE INVENTION

1. Field of the Invention

This invention relates to shotgun sights and more particularly to an attachment for shotguns on which front and rear front sights can be mounted.

Shotguns are used in different situations. When hunting fowl, for example, a spray of small pellets is desired. When hunting bear, on the other hand, a slug is used and different sights are required. Since the sights are fixedly mounted on the shotgun barrel, a variety of shotgun barrels are required to perform each of a series of many different functions. With each gun barrel, a specific sight is provided which also may not be the sight desired by different individuals using a shotgun.

It has long been recognized that detachable sights, both front and rear, are advantageous. In the Seymore et al patent, U.S. Pat. No. 2,795,048, a detachable platform for a rear gun sight is provided. The platform taught by Seymore, et al is slid on and off the shotgun. Seymore, et al provides for a gun barrel that is ribbed. Thus, with the Seymore et al platform, where a ribbed gun barrel is available, the platform is prevented from rotating on the barrel. However, with the platform taught by Seymore, et al, absent a ribbed gun barrel, there is nothing to prevent the platform from rotating about the barrel. Also, with Seymore, et al, the existing front sight Is used and no replacement therefor is possible except if the barrel itself permits a change of the front sight which is most unlikely.

The Bedford patent, U.S. Pat. No. 3,975,851, also provides a mounting for a rear sight that makes no provision for a front sight and, as a result, is limited to the use of whatever front sight is mounted on the barrel. Bedford uses legs, similar to Seymore, et al, which rest on the barrel but, in addition, has an elongated plate which extends from the legs toward the front of the gun. According to Bedford, the elongated plate serves as a foundation for a system to adjust the rear sight which is also mounted on the platform. Bedford provides nothing firmly to secure the platform to the barrel except for whatever gripping action the legs may provide. Bedford also does not provide for a front sight.

OBJECTS

It would be clearly advantageous to have a platform for use on a shotgun which is firmly secured to the shotgun for mounting interchangeably both front and rear sights on the shotgun.

Accordingly, the objects of this for invention are as follows:

To provide a platform for mounting both a front sight and a rear sight on a shotgun.

To provide a platform for mounting interchangeably a variety of both front and rear sights on a shotgun.

To provide a platform for mounting sights on a shotgun that is firmly secured to the shotgun.

To provide a platform for sights on a shotgun that is quickly and easily installed on a shotgun.

To provide a platform for sights on a shotgun that can be economically produced and is durable.

To provide a platform that can be adapted to a variety of shotguns.

These and other objects will be apparent to those skilled in the art based upon the description of the preferred embodiment.

SUMMARY OF THE INVENTION

A shotgun sight attachment is provided for use with a shotgun for mounting sights. An elongated member is included which has a front end and a rear end as well as a lower surface and an upper surface. A saddle is connected to the lower surface of the elongated member at the rear end of the elongated member. A front plate is mounted at the front end of the elongated member which extends from the lower surface away from the upper surface. A pair of openings are located in the front plate.

| NUMERAL | DESCRIPTION |
|---|---|
| 11 | Rear End (Attachment) |
| 13 | Front End (Attachment) |
| 15 | Shotgun |
| 17 | Front End (Shotgun) |
| 19 | Elongated Member |
| 21 | Top of Shotgun |
| 23 | Front End (Elongated Member) |
| 25 | Rear End (Shotgun) |
| 27 | Top Surface (Elongated Member) |
| 29 | Bottom Surface (Elongated Member |
| 31 | Saddle |
| 33 | Rounded Legs |
| 35 | Inside Surface (Saddle) |
| 37 | Barrel |
| 38 | Outside Surface (Saddle) |
| 39 | Interior Coating (Saddle) |
| 41 | Front Plate |
| 43 | Two Openings |
| 45 | Upper Opening |
| 47 | Lower Opening |
| 49 | Slot |
| 51 | Centerline |
| 53 | Circular Portion (Upper Opening) |

-continued

| NUMERAL | DESCRIPTION |
|---|---|
| 55 | Sights |
| 57 | Front Sight |
| 59 | Rear Sight |
| 61 | Machine Screws |
| 63 | Threaded Opening |
| 65 | Base |
| 67 | Scope |
| 69 | Magazine |
| 71 | Magazine Cap |
| 73 | Fixed Front Sight |
| 75 | Opening (Magazine) |
| 77 | Stock |
| 79 | Front End (Stock) |
| 81 | Threaded Insert |
| 83 | Cover |
| 85 | Stud Bolt |

DESCRIPTION OF THE PREFERRED EMBODIMENT

Figure 1:
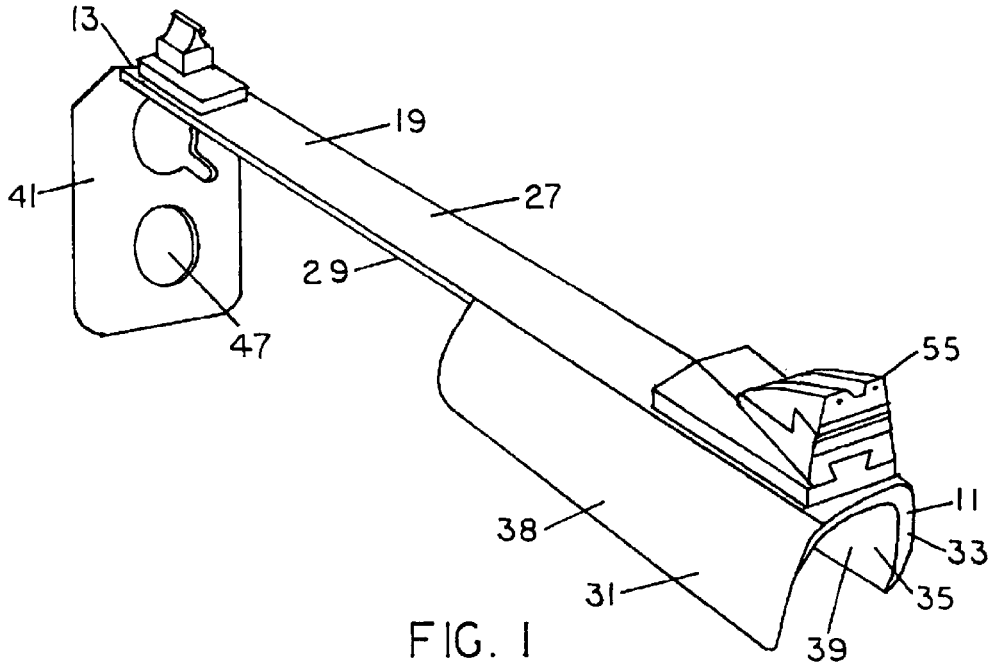
FIG. 1 is a perspective view of the Shotgun Sight Attachment showing the top and side of the Shotgun Sight Attachment from the rear toward the front with both a front and rear sight mounted on the Shotgun Sight attachment.
Figure 2:
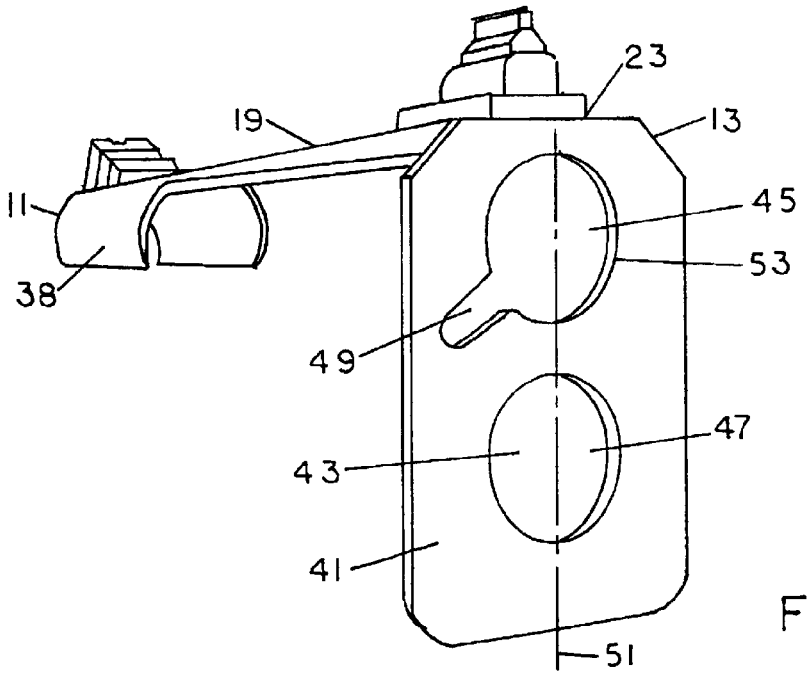
FIG. 2 is a perspective view of the Shotgun Sight Attachment showing the front plate and the saddle connected by the elongated plate with both a front and a rear sight mounted on the Shotgun Sight Attachment.

Referring now to FIG. 1 and FIG. 2, the Shotgun Sight Attachment is shown from (hereinafter referred to as the "Attachment") is shown from both the rear end 11 (FIG. 1) and from the front end 13 (FIG. 2). The front end 13 of the Attachment is located toward the front end 17 or discharge end of the shotgun 15.

An elongated member 19 sits on the top 21 of the shotgun 15. The elongated member 19 is a flat strip having a generally rectangular shape. The elongated member 19 has the same front end 13 and the same rear end 11 as does the Attachment. The shotgun 15 similarly has, as mentioned, a front end 17, and a rear end 25. The front end 13 of the elongated member 19 is mounted toward the front end 17 of the shotgun 15 and the rear end 11 of the elongated member 19 is mounted toward the rear end 25 of the shotgun 15. The elongated member 19 has a top surface 27 which is mounted away from the shotgun 15 and a bottom surface 29 which is against the shotgun 15.

At the rear end 11 of the Attachment, a saddle 31 is rigidly mounted on the bottom surface 29 of the elongated member 19. The saddle 31 includes a pair of rounded legs 33 with an inside surface 35 generally formed to the shape of the barrel 37 of the shotgun 15. The saddle 31 is generally speaking a half of a circular tube. The inside surface 35 of the saddle 31 rests against the barrel 31. An outside surface 38 of the saddle 31 is exposed when the saddle 31 is mounted on the barrel 37. The Attachment can be made from steel, aluminum or a strong plastic and possibly other materials. The saddle 31 rests on the barrel 37 and an interior coating 39 such as rubber or cloth may be affixed to the inside surface 35 of the saddle 31 to prevent any damage to the barrel 37 from the saddle 31.

At the front end 13 of the elongated member 19, a front plate 41 is secured to the bottom surface 29 of the elongated member 19 at substantially right angles to the elongated member 19. The front plate 41 is generally a rectangular sheet with the corners rounded. The front plate 41 has two openings 43, an upper opening 45 and a lower opening 47, generally of the same size and circular but with the upper opening 45 including a slot 49 extending radially from it. The upper opening 45 is located directly above the lower opening 47 and the two openings 43 are in line with one another. The centerline 51 of the two openings 43 is substantially the centerline 43 of the front plate 41. The upper opening 45 is located closest to the elongated member 19 and the lower opening 47 is located beneath the upper opening 45 remote from the elongated member 19. The slot 49 of the upper opening 45 extends from circular portion 53 of the upper opening 45 at approximately a forty-five degree angle to the centerline line 51 of the two openings 43. The slot 49, which is part of the upper opening 45 gives the upper opening 45 a keyhole shape. The purpose of the keyhole shape of the upper opening 45 is subsequently explained in the operational explanation set forth hereinafter.

Figure 4:
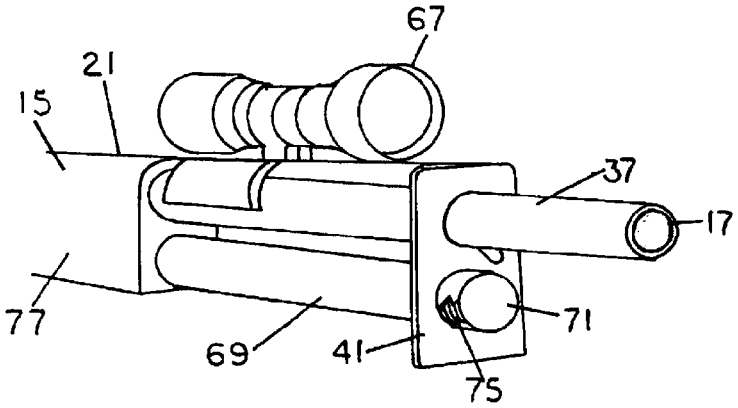
FIG. 4 is a perspective view of a different style of shotgun than that shown in FIG. 3, showing the front and side of the front end of the shotgun with the Shotgun Sight Attachment mounted on the shotgun and with a scope mounted on the Shotgun Sight Attachment in place of the front and rear sights.
Figure 5:
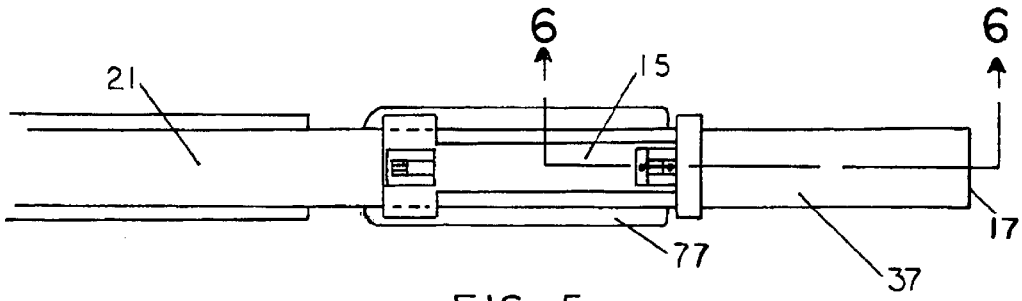
FIG. 5 is a plan view of the top of a portion of a shotgun with a Shotgun Sight Attachment mounted on it.
Figure 6:
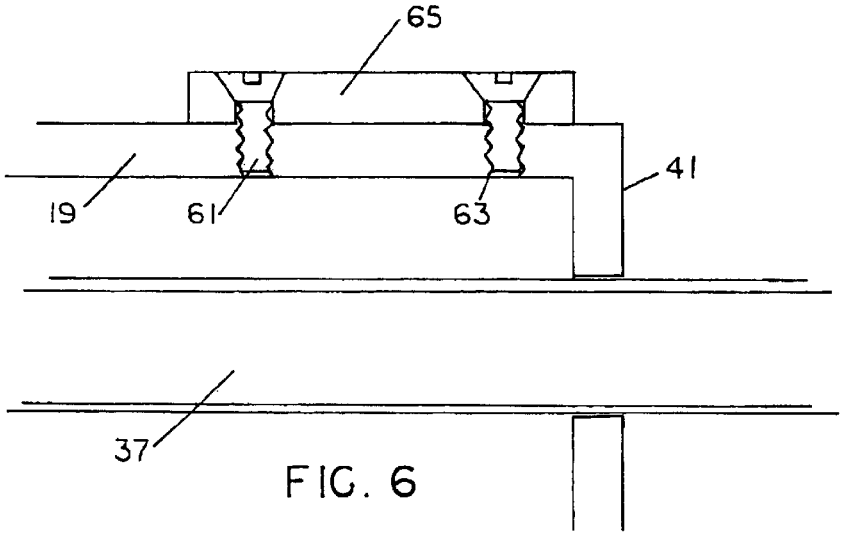
FIG. 6 is a cross section of a part of a front sight showing stud bolts holding the front sight on the elongated member.
Figure 7:
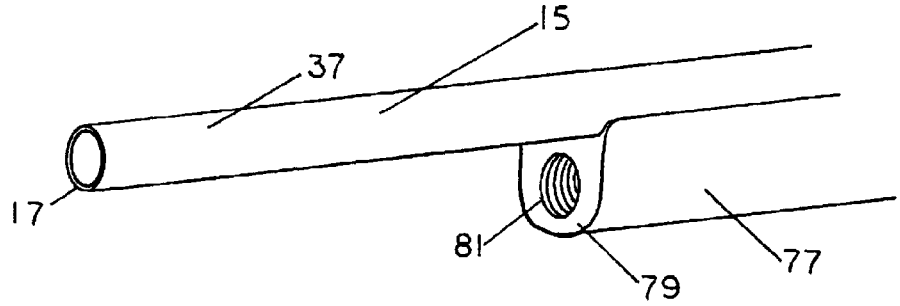
FIG. 7 is a perspective view of the front portion of a shotgun that does not have a magazine cap showing a threaded insert placed into the stock of the shotgun.
Figure 8:
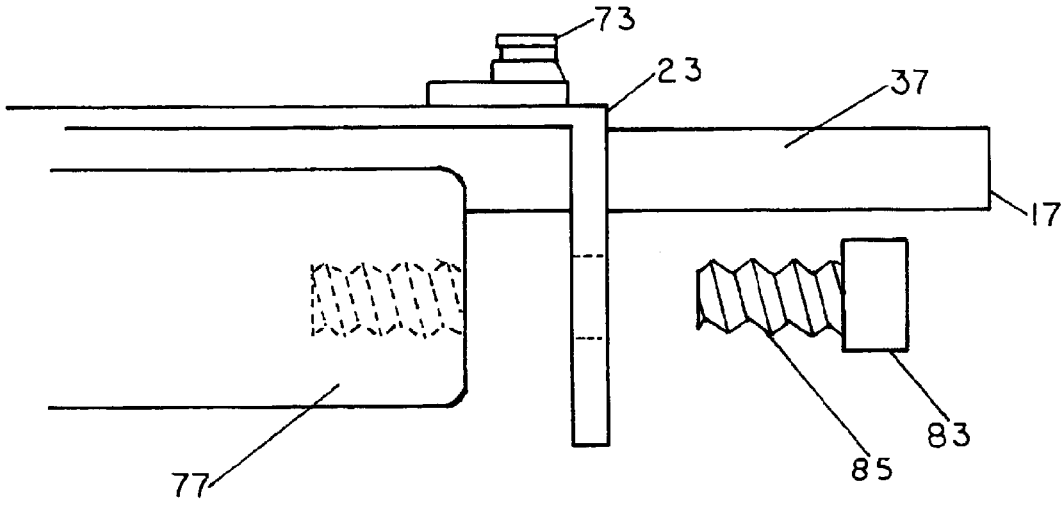
FIG. 8 is a cross sectional exploded view of a shotgun such as is shown in FIG. 7 showing the Shotgun Sight Attachment, a cover and a threaded bolt to engage the threaded stud.

The purpose of the Attachment is to permit the ready installation of a wide variety of sights 55. The sights 55, however, are used with the Attachment but are not part of the Attachment. Mounted on the front end 11 of the elongated member 19 is a front sight 57 and at the rear end 11 of the elongated member 19, a rear sight 59 is mounted. As previously stated, The front sight 57 and the rear sight 59 are removable and replaceable. The front sight 57 and the rear sight 59 may be attached to the elongated member 19 in a variety of ways including the use of rivets (not shown). However, by using machine bolts 61 and threaded openings 63 (FIG. 5) through the base 65 of the sights 55 and into the elongated member 19, both the front sight 57 and the rear sight 59 can be easily installed and replaced. Also as seen in FIG. 4, a scope 67 may be installed on the Attachment in place of the front sight 57 and the rear sight 59. Sights 55 include a scope 67 or any other form of equipment for aiming the shotgun 15.

Figure 3:
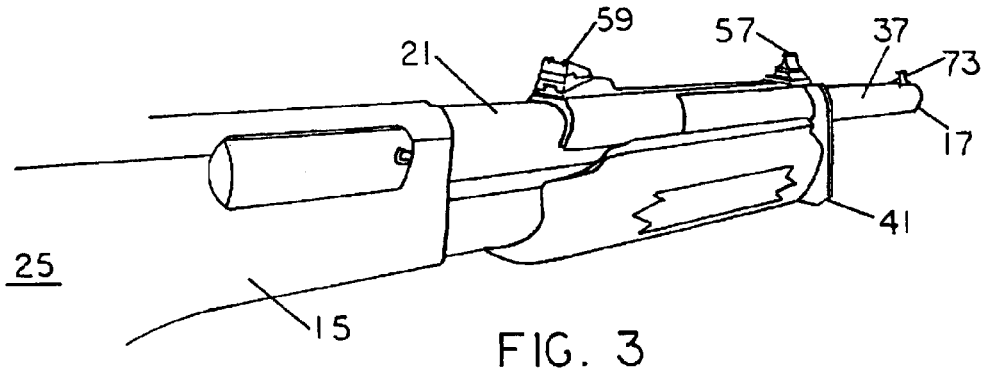
FIG. 3 is a perspective view of a shotgun from the rear side toward the front showing the sight attachment on the shotgun with both a front sight and a rear sight.

The Attachment may be used with a variety of shotguns 15 but one shotgun 15 which permits the easy installation of the Attachment is the Remington[1] 870 shotgun. The Remington 870, shown in FIG. 3, includes a magazine 69 and a magazine cap 71 (FIG. 4) The magazine cap 71 is shown on a different shotgun 15 in FIG. 4. A shotgun 15 with a magazine 69 and a magazine cap 71 is most adaptable to use with the Attachment and the Remington 870 shotgun is a prime example.

[1]. Remington is a registered trademark of the Remington Arms Compay Inc.

Since the barrels 37 of most shotguns 15 include a fixed front sight 73, the slot 49 is vital to permit the Attachment to fit onto a shotgun 15. The slot 49 is aligned with the fixed front sight 73 on the barrel 37 of the shotgun 15, if a fixed front sight 73 exists and the Attachment is slid back over the barrel 37 of the shot gun 15 and the saddle 31 is set on the barrel 37. Before placing the Attachment in place, the magazine cap 71, if one exists, is removed. When the Attachment is in place, the lower opening 47 is aligned with the opening 75 into the magazine 69 and the magazine cap 71 is again threaded into the opening 75 into the magazine 69. This secures the Attachment in place and whatever sights 55 or scope 67 are installed on the Attachment. Of course, the front sight 57 and the rear sight 59 or the scope 67 may be installed before the Attachment is mounted on the shotgun 15. The fixed front sight 73 originally mounted on the barrel 37 is not used and is merely left in place but essentially ignored.

With a shotgun 15 that has no magazine 69 and magazine cap 71, the stock 77 of the shotgun 15 at the front end 79 of the stock 77 must be fitted with a threaded insert 81 and a cover 83, similar to a magazine cap 71. Accordingly, the attachment is held in place by a stud bolt 81 extending from the center of a cover 83, that is turned down into the threaded insert 81 to hold the cover 83 against the front plate 41 which in turn is held against the front end 79 of the stock 77. As a result, the Attachment is held firmly in place. The installation of the threaded insert 81 is simple and a cover 83 that is decorative and a stud bolt 85 that is decorative preserves the appearance of the shotgun 15 whether of not the Attachment is in place.

It is to be understood that the drawings and description matter are in all cases to be interpreted as merely illustrative of the principles of the invention, rather than as limiting the same way, since it is contemplated that various changes may be made in various elements to achieve like results without departing from the spirit of the invention or the scope of the appended claims.

What is claimed is:

1. A shotgun sight attachment for use with a shotgun to mount sights, said shotgun sight attachment comprising:

an elongated member having a front end and a rear end and a lower surface and an upper surface;

a saddle connected to the lower surface of the elongated member at the rear end of the elongated member; and a front plate mounted at the front end of the elongated member and extending from the lower surface away form the upper surface, the front plate having an upper opening and a lower opening, the lower opening being directly beneath the upper opening, the upper opening and the lower opening being circular and having a centerline, a slot extending from the upper opening at approximately forty-five degrees to the centerline.

2. A shotgun sight attachment for use with a shotgun to mount sights, said shotgun sight attachment comprising:

an elongated member having a front end and a rear end and a lower surface and an upper surface, the elongated member being a flat plate;

a saddle connected to the lower surface of the elongated member at the rear end of the elongated member, the saddle being approximately half a circular tube; and a front plate mounted at the front end of the elongated member extending generally at right angles from the lower surface of the elongated member substantially at a right angle to the elongated member and away from the upper surface, the front plate having an upper opening and a lower opening the lower opening being directly beneath the upper opening, the upper opening and the lower opening being circular and having a centerline, a slot extending from the upper opening at approximately forty-five degrees to the centerline.

3. A shotgun sight attachment for use with a shotgun to mount sights, said shotgun sight attachment comprising:

an elongated member having a front end and a rear end and a lower surface and an upper surface, the elongated member being a flat plate with a rectangular shape;

a saddle connected to the lower surface of the elongated member at the rear end of the elongated member, the saddle including a pair of rounded legs and being approximately half a circular tube; and a front plate mounted at the front end of the elongated member extending generally at right angles from the lower surface of the elongated member substantially at a right angle to the elongated member and away from the upper surface, the front plate having an upper opening and a lower opening, the upper opening being directly above the lower opening, the upper opening having a circular portion with a slot extending from it and the lower opening being circular, the lower opening and the circular portion of the upper opening being generally the same size and having a centerline, the slot being located at approximately forty five degrees to the centerline.

* * * * *